US005924365A

United States Patent [19]

Pircher

[11] Patent Number: 5,924,365

[45] Date of Patent: Jul. 20, 1999

[54] CONVEYOR SYSTEM WITH CONVEYOR CARRIAGE RUNNING ON RAILS

[75] Inventor: Herbert Pircher, Planegg, Germany

[73] Assignee: Telelift GmbH, Puchheim, Germany

[21] Appl. No.: 08/952,599

[22] PCT Filed: May 14, 1996

[86] PCT No.: PCT/EP96/02058

§ 371 Date: Dec. 12, 1997

§ 102(e) Date: Dec. 12, 1997

[87] PCT Pub. No.: WO96/37394

PCT Pub. Date: Nov. 28, 1996

[30] Foreign Application Priority Data

May 26, 1995 [CH] Switzerland ..... 1567/95

[51] Int. Cl.[6] ..... B61C 13/00

[52] U.S. Cl. ..... 105/29.1; 105/155; 104/94

[58] Field of Search ..... 105/29.1, 29.2, 105/30, 32, 33, 155; 104/94

[56] References Cited

U.S. PATENT DOCUMENTS

| | | | |
|---|---|---|---|
| 3,636,883 | 1/1972 | Wesener . | |
| 4,422,384 | 12/1983 | Johnson et al. | 105/29.1 |
| 4,563,956 | 1/1986 | Wiechert et al. | 105/29.1 |
| 4,703,698 | 11/1987 | Kazlauskas | 105/29.1 |
| 5,461,985 | 10/1995 | Gersemsky | 105/30 |

FOREIGN PATENT DOCUMENTS

| | | | |
|---|---|---|---|
| 1 481 839 | 7/1969 | Germany . | |
| 32 04 155 A1 | 9/1983 | Germany . | |
| 33 07 488 A1 | 9/1984 | Germany . | |
| 35 05 413 A1 | 8/1986 | Germany . | |
| 4205858 | 9/1993 | Germany | 105/30 |
| 33 09 377 A1 | 9/1994 | Germany . | |

*Primary Examiner*—Mark T. Le
*Attorney, Agent, or Firm*—Herbert Dubno

[57] ABSTRACT

A conveyor carriage has running wheels guided in rail parts so as to prevent the conveyor carriage from lifting off transversely to the plane of the rails. Each conveyor carriage contains a driving unit with at least one driving wheel prestressed against the rail. In order to move the conveyor carriage manually, a lifting device allows the driving wheel to be lifted off and disengaged from the rail. In order to simplify the lifting device, the lifting device is equipped with a shaft mounted on the conveyor carriage adjoined to the driving unit by a flexible coupling member.

4 Claims, 3 Drawing Sheets

CONVEYOR SYSTEM WITH CONVEYOR CARRIAGE RUNNING ON RAILS

CROSS REFERENCE TO RELATED APPLICATIONS

This application is a national phase of PCT/EP96/02058 filed May 14, 1996 and based, in turn, in national application 1567/95-0 in Switzerland, filed May 26, 1995 under the International Convention.

FIELD OF THE INVENTION

The invention relates to a conveyor system. More particularly, the invention relates to a conveyor system of the type in which a conveyor carriage has running wheels riding on rails and the carriage cannot be lifted transversely off the rails and wherein at least one driving wheel on the carriage is prestressed against one of the rails.

BACKGROUND OF THE INVENTION

Several conveyor systems of the above mentioned type are known, for example from U.S. Pat. No. 3,636,883. With such conveyor carriages that cannot be lifted off from the rails, that the driving wheel is active at all times. Depending on the type of gear mechanism, the resistance in a driving wheel can range from infinity in the case of a self-locking gear, to nearly zero in the case where no transmission gear is present between the motor and the driving wheel. Accordingly, depending on the construction of the gear mechanism, the driving wheel will exert a variable resistance against a manual displacement, so that movement of the conveyor carriages within the rails may be either impossible or difficult.

OBJECT OF THE INVENTION

The aim of the invention is to provide a conveyor system of the kind described hereinabove, in which the conveyor carriage can also be moved manually if this should be necessary.

SUMMARY OF THE INVENTION

This object is achieved according to the invention by providing a device for lifting off the driving wheel from the rail that is accessible from outside and can be actuated manually. The driving wheel can thus be disengaged and the conveyor carriage can be moved manually, which is advantageous, e.g. in case of malfunctions, shunting manoeuvres or corrections of the position of the conveyor carriage.

In principle, it is possible to provide the conveyor carriage with only one driving wheel, which can be designed as a friction wheel or as a gear wheel. In many cases the conveyor carriage will contain as driving wheels both a friction wheel and a gear wheel that are arranged next to each other on the same shaft, such that when the gear wheel is engaged, the friction wheel is disengaged, whereas in the absence of a tooth rack the driving action is taken over by the friction wheel.

There are several possibilities for ensuring the prestressing of the driving wheel. For example, the driving unit may be disposed basically rigidly, with only the driving axis being movable and pre-stressed transversely to the plane of the rails. Particularly advantageous is an embodiment wherein the driving unit is swivel-mounted on the carriage about an axis that is parallel but spaced from an axis of the driving wheel.

There are also various possibilities for the device for lifting off the driving wheel from the rail. More particularly, the lifting device can have a shaft that is rotatably mounted to the running gear of the conveyor carriage and the shaft can be connected through a coupling member with the driving unit such that upon a swiveling of the shaft, the driving with its driving wheel is lifted off from its rail. The coupling member thereof can be a cam plate or a lever gear, but an embodiment wherein the coupling member is a flexible element that is connected at one end with the driving unit and at the other end can be wound on the shaft, is particularly advantageous.

It is particularly advantageous if the lifting device is designed in such a way that it is lockable in the lift-off position of the driving wheel, so that the lifting device needs not be continuously actuated until the displacement process has been completed. However, the locking should not occur in every case but only in a second phase of the displacement of the lifting device, whereas in a first phase the lifting device should have to be constantly held manually in order to ensure that upon release of the lifting device the automatic engaging of the driving device on to the rail is guaranteed. An advantageous construction of the locking device provides that the shaft will have a basic position in which it is prestressed by means of a spring with a step against an abutment. The shaft is further guided in a bore and has at least one radial ledge that engages in a radial recess in the wall of the bore. The bore has a further radial recess corresponding to the locking position in which the radial ledge engages after swiveling outside of the bore.

Particularly advantageous is a further embodiment of the conveyor system, which prevents the driving wheel from lifting off unintentionally from the rail.

In this further embodiment the shaft is provided with a locking cam which, in a basic position of the shaft, abuts against an abutment of the driving unit so as to prevent it from swiveling.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
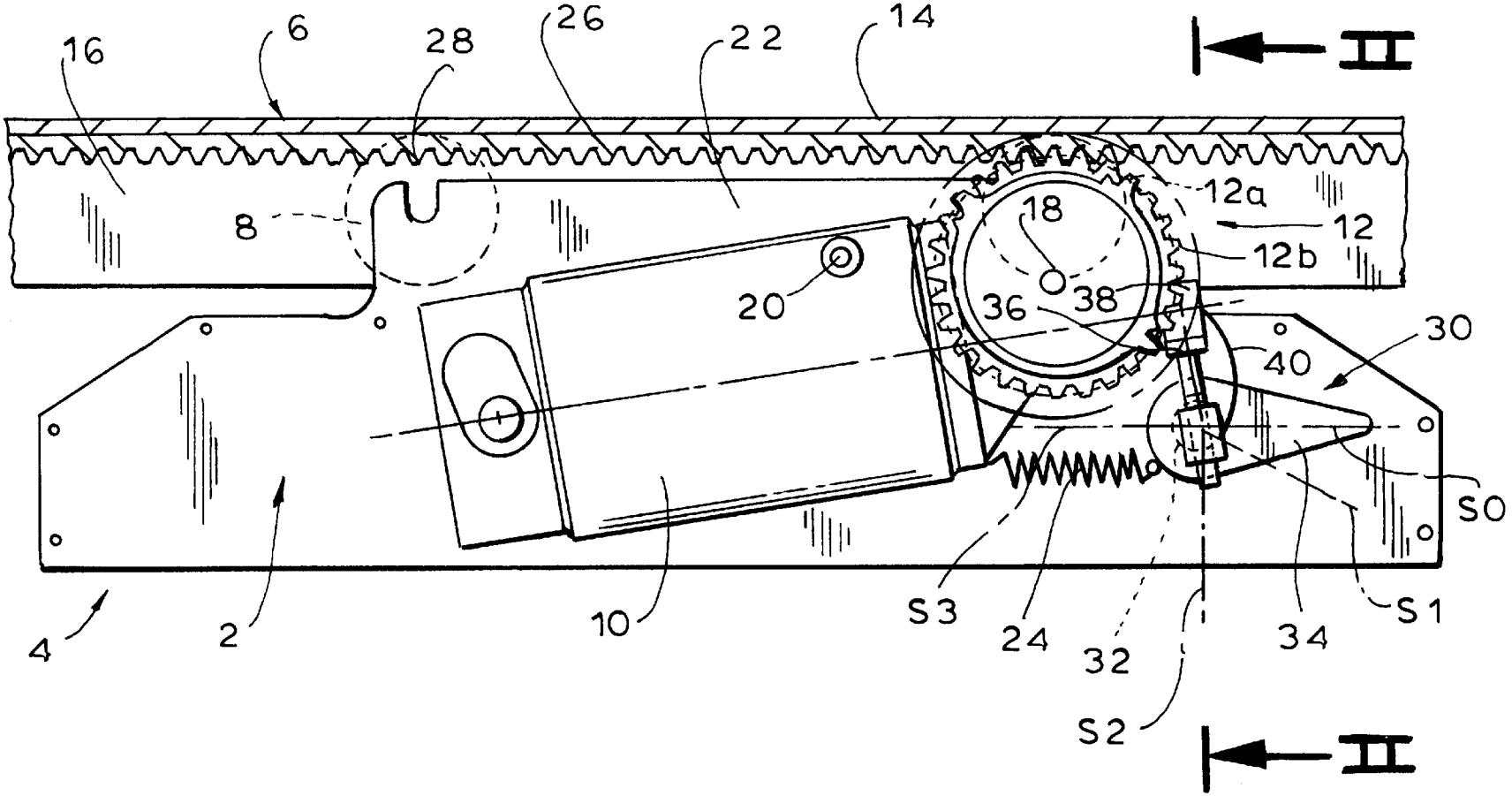
FIG. 1 is an elevational view which shows the running gear of a conveyor carriage hanging in a rail, in section along line I—I of FIG. 2.
Figure 2:
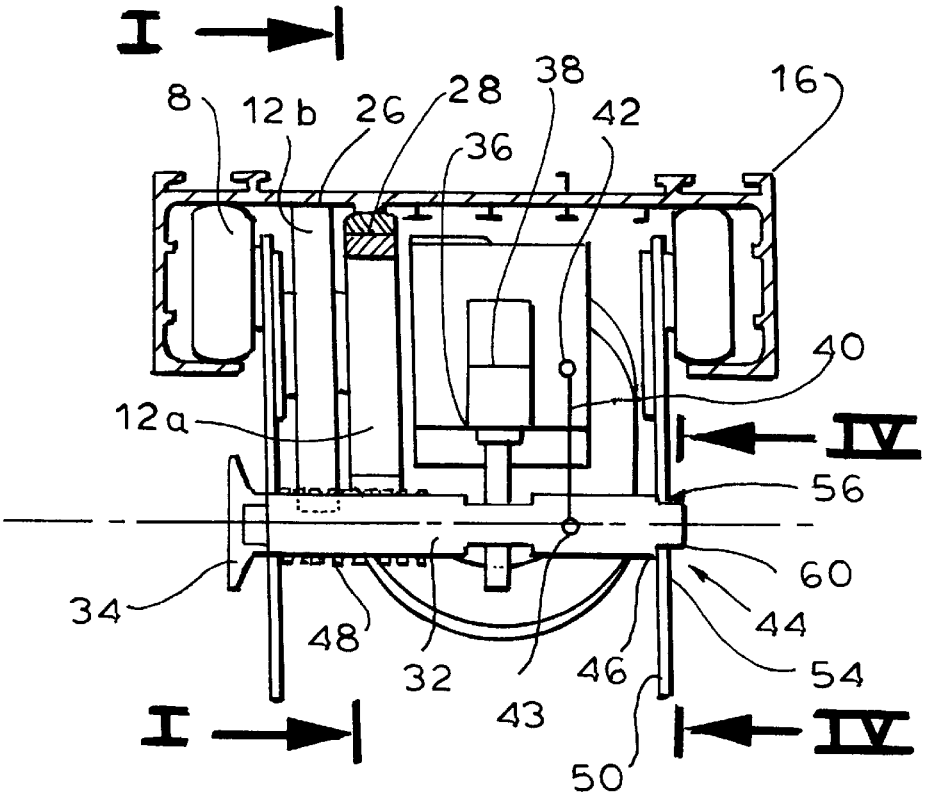
FIG. 2 is a sectional view which shows the conveyor system of FIG. 1, in section along line II—II of FIG. 1.
Figure 4:
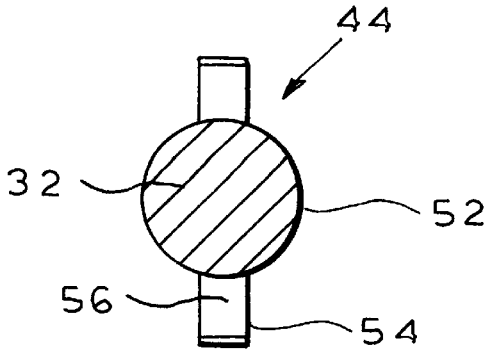
FIG. 4 is a detail view which shows the mounting of a lifting shaft, in section along IV—IV of FIG. 2.
Figure 3:
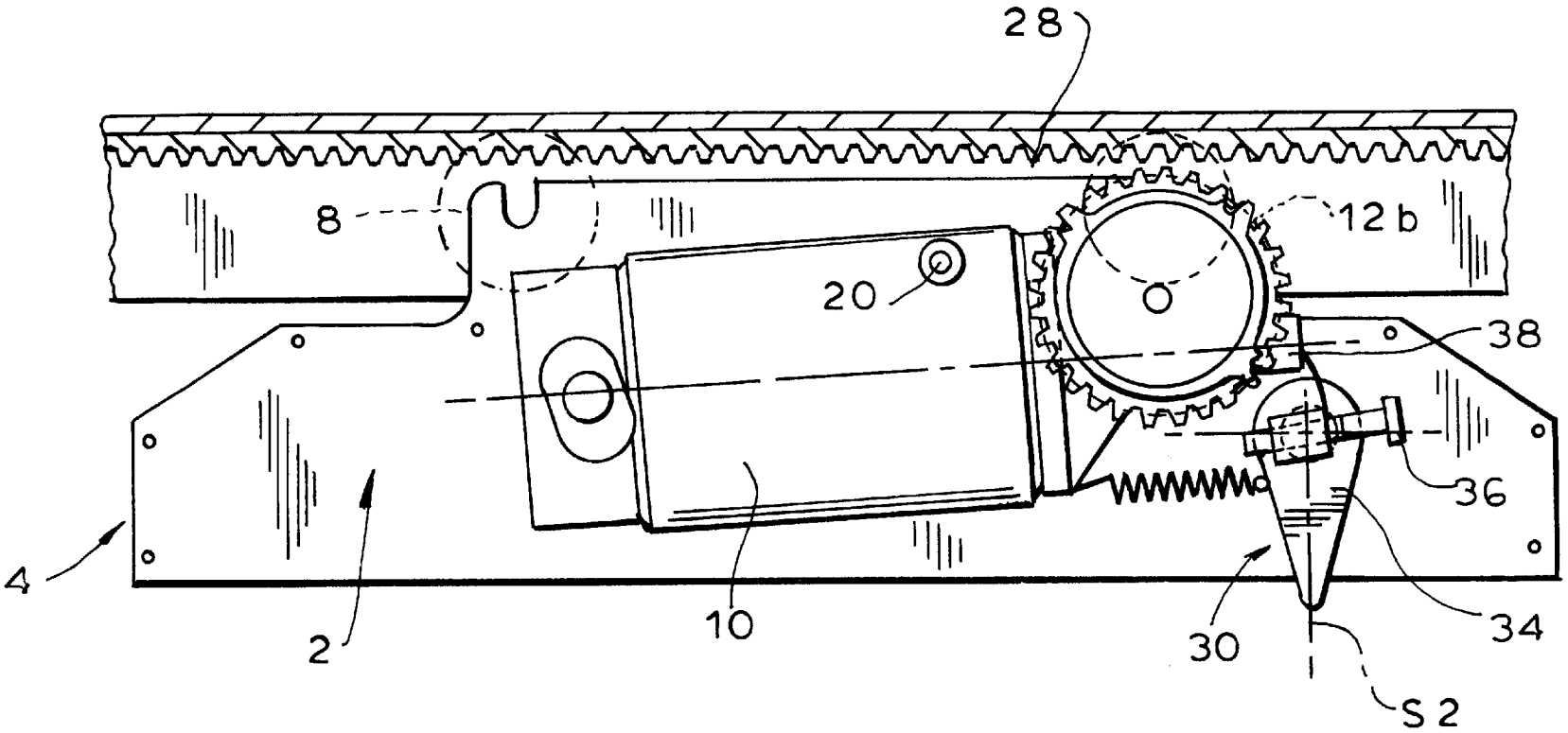
FIG. 3 is a view similar to FIG. 1 which shows the conveyor system of FIG. 1 with the driving wheel lifted off.

The parts of the conveyor system represented in detail in the figures show the running gear 2 of a conveyor carriage 4 in a rail 6. The conveyor carriage includes running wheels 8 and a driving wheel 12 driven by a driving unit 10, which driving wheel in the instant case includes a friction wheel 12*a* and a gear wheel 12*b*. The conveyor carriage 4 runs in a rail 6 that prevents the conveyor carriage from lifting off transversely to the rail plane. For example, the rail includes a rail base 14 and lateral rail parts 16 that engage running wheels 8 in a C-shape, so that the conveyor carriage 4 cannot be removed perpendicularly from the rails.

The driving unit 10 is swivel-mounted on frame 22 of running gear 2 around an axis 20 that is parallel to axis 18 of the driving wheel 12. A biasing spring 24 pre-stresses driving wheel 12 against the rail base 14, so that either friction wheel 12*a* is engaged with a friction surface 26 of the rail base 14 or, like in the example shown, gear wheel 12*b* is engaged with a tooth rack 28 at the rail base 14.

The conveyor carriage 4 is provided with an externally manually actuated device 30 for lifting the driving wheel 12, 12*a* or 12*b*, respectively, from rail 6. This lifting device 30 includes a shaft 32 disposed parallel to the drive axis, which shaft is rotatably and axially movably mounted in running gear 2. The shaft is provided with a handle 34 that permits swivelling of shaft 32 as well as axial movement of shaft 32, as will be described in more detail hereinbelow. Shaft 32 is provided with a locking cam 36 that in its basic position S0 according to FIG. 1 abuts against an abutment 38 of the driving unit 10, so as to prevent swivelling of the latter. Furthermore, shaft 32 is connected with driving unit 10 by means of a coupling member 40, said coupling member 40 consisting of a flexible element, such as a rope, belt or ribbon, one end 42 of which is attached to the driving unit 10 and the other end 43 of which is attached to shaft 32. Upon swivelling of shaft 32, coupling member 40 is wound up on the shaft, while at the same time locking cam 36 is disengaged from abutment 38 and coupling member 40 is wound up on shaft 32. Thereby, driving unit 10 is swivelled against the force of biasing spring 24 until driving wheel 12 is disengaged from rail 16.

The lifting device 30 is provided with locking device 44, which locks the lifting device in the basic position S0 shown in FIG. 1, in order to prevent unintentional swivelling of shaft 32. For this purpose, shaft 32 is provided with a step 46, so that by means of a biasing spring 48 shaft 32 is brought into contact through step 46 against a wall 50 that is located on the side remote from handle 34. In wall 50 there is included a bore 52 that includes two diametrically opposite radial recesses 54, into each of which a radial ledge 56 of shaft 32 engages and thereby secures the shaft against swivelling. Shaft 32 can be displaced in axial direction 58 by means of handle 34 until the shaft is in contact with the outer part of wall 50 by means of a securing ring 60, whereby radial ledges 56 are disengaged from radial recesses 54 and the shaft can be swivelled, as can be deduced from FIG. 1. Position S0 is the basic position in which driving wheel 12 is engaged with rail base 14. Upon swivelling by about 30° into the first position S1, locking cam 36 is released. Upon further swivelling by 90° into position S2, gear wheel 12*b* is disengaged from tooth rack 28, so that the conveyor carriage can be moved along rail 6. In this position, handle 34 has to be held in place manually, otherwise biasing spring 24 would move back driving unit 10 into the basic position. only upon further swivelling of the handle 34 by 180° from the basic position S0 into position S3 can the lifting device 30 be locked, by engaging radial ledges 56 into radial recesses 54. Such a locking is, however, only advisable where the rail takes a horizontal course. In case of oblique or even vertical course of the rail the locking should not be used, in order to ensure that in the event of unintentional release of handle 34 the gear wheel 12*b* immediately engages into tooth rack 28, thus preventing an undesired departure of the conveyor carriage.

I claim:

1. A conveyor system comprising a conveyor carriage running on rails, said conveyor carriage having:

a running gear with running wheels guided in parts of said rails so as to prevent the conveyor carriage from lifting off transversely to a plane of the rails;

a driving unit on the carriage that is pre-stressed against one of the rails and swivel-mounted about an axis parallel to but spaced from an axis of a driving wheel of the driving unit; and a lifting device carried on the running gear for lifting off the driving wheel from said one of said rails, said lifting device including a movable part movable between a basic position in which the driving wheel is pre-stressed against said one of said rails, a labile lift-off position and a stable lift-off position, said movable part having a shaft that is rotatably mounted to the running gear of the conveyor carriage and that is provided with a handle accessible on the outside of the running gear, the shaft being connected with the driving unit by a flexible coupling member that is windable up onto the shaft.

2. The conveyor system according to claim 1, wherein the lifting device is lockable in the stable lift-off position.

3. The conveyor system according to claim 2, wherein the shaft in its basic position is pre-stressed by means of a spring with a step against an abutment of the running gear, the shaft further being guided in a bore and being provided with at least one radial ledge that engages in a radial recess in the wall of the bore, the bore including a further radial recess corresponding to a locking position, into which the radial ledge engages after swivelling outside of the bore.

4. The conveyor system according to claim 1 wherein the shaft is provided with a locking cam, which in the basic position of the shaft abuts against an abutment of the driving unit, so as to prevent it from swivelling.

* * * * *